US008083428B2

(12) United States Patent
Martinez De San Vicente Oliveras

(10) Patent No.: US 8,083,428 B2
(45) Date of Patent: Dec. 27, 2011

(54) DEVICE FOR APPLYING DEPILATION WAX

(75) Inventor: Luis Martinez De San Vicente Oliveras, Cornella de Llobregat (ES)

(73) Assignee: Ceras Especiales Martinez de San Vicente, S.A., Cornella de Llobregat (ES)

( * ) Notice: Subject to any disclaimer, the term of this patent is extended or adjusted under 35 U.S.C. 154(b) by 1016 days.

(21) Appl. No.: 11/995,824

(22) PCT Filed: Jun. 23, 2006

(86) PCT No.: PCT/EP2006/006057
§ 371 (c)(1),
(2), (4) Date: Jan. 16, 2008

(87) PCT Pub. No.: WO2007/009552
PCT Pub. Date: Jan. 25, 2007

(65) Prior Publication Data

US 2008/0210159 A1 Sep. 4, 2008

(30) Foreign Application Priority Data

Jul. 22, 2005 (ES) ..... 200501800

(51) Int. Cl.
*B43M 11/02* (2006.01)

(52) U.S. Cl. ..... 401/219; 401/1; 401/208

(58) Field of Classification Search ..... 401/208, 401/218–220, 1, 2, 216, 197
See application file for complete search history.

(56) References Cited

U.S. PATENT DOCUMENTS

| | | | | |
|---|---|---|---|---|
| 2,732,575 | A * | 1/1956 | Faust | 401/220 |
| 5,213,431 | A * | 5/1993 | Gentile et al. | 401/219 |
| 5,803,636 | A * | 9/1998 | Legrain et al. | 401/1 |

FOREIGN PATENT DOCUMENTS

| | | |
|---|---|---|
| EP | 0 629 366 | 12/1994 |
| EP | 0 786 214 | 7/1997 |
| ES | 1 016 006 U | 10/1991 |
| ES | 2 026 370 A6 | 4/1992 |
| ES | 2 076 224 T3 | 11/1995 |
| ES | 2 187 693 | 6/2003 |
| FR | 2 757 029 | 6/1998 |

* cited by examiner

*Primary Examiner* — David Walczak
(74) *Attorney, Agent, or Firm* — Sughrue Mion, PLLC

(57) ABSTRACT

A device (1) for applying depilation wax, including a shell (2) open at the top and housing a heated reservoir (3) with an upper opening suitable for storing hot wax. A head is attached to the opening of the shell (2) and includes a runner moveable longitudinally with respect to the head, which holds a rotable roller (6) used to apply the wax stored in the reservoir (3). The runner has a mechanism (11) for holding the roller (6) that includes a swinging forked element (7) onto which the turning axle (12) of the roller (6) is held in an adjustable position and rotateable, it being possible to turn the forked element with respect to the runner in order to move the roller (6) in an essentially transverse direction with respect to the imaginary longitudinal axis (13) of the applicator.

14 Claims, 2 Drawing Sheets

DEVICE FOR APPLYING DEPILATION WAX

CROSS-REFERENCE TO RELATED APPLICATION

This application is a 371 of PCT/EP2006/006057, filed Jun. 23, 2006; the disclosure of which is incorporated herein by reference.

TECHNICAL FIELD OF THE INVENTION

The present invention relates to an applicator for thermofusible products, such as depilation wax, especially suitable for professional use in hairdressing salons and beauty treatment establishments.

BACKGROUND OF THE INVENTION

The depilation technique of applying a thermofusible product, such as, for example, depilation wax, consists in melting a certain amount of this product which, at room temperature, is in a solid or doughy form, and applying a layer of the product onto the area to be depilated. After it has dried, i.e. once it has cooled, the film of thermofusible product is removed with the help of any appropriate means, the hairs on the skin then being removed due to their solidification with the melted thermofusible product.

Devices for applying depilation wax are currently known which are stored in a reservoir of wax which is heated by any appropriate means. Said reservoirs can consist either of non-refillable cartridges for single use only, which are inserted in the wax application devices, or of receptacles which are fixed inside the application devices, whose opening can be accessed from the outside so that the reservoirs can be refilled, as the wax stored is gradually dispensed.

In order to dispense the wax, the devices include a simple wax roller for distributing the wax so that the wax can be deposited on the skin in thin layers. These rollers are attached either to the replaceable cartridge or to the heads positioned on the devices which house fixed reservoirs.

An example of a cartridge with a built-in roller is disclosed in ES1016006U. The cartridge disclosed comprises a holder for the roller, removably attached to the opening of the cartridge, which must turn at an angle of 90° in order to be separated from the cartridge. Once the holder has been removed, the roller can be replaced. This system allows the roller to be changed manually, thus eliminating any problems of hygiene, which resulted from the same roller being used for different people.

Another example of a cartridge with an application roller is disclosed in ES2026370, which describes an interchangeable head in the form of a roller, which is attached to the wax cartridge. This head is positioned between two opposite sides of the cartridge opening, which can be adjusted to fit into a support frame with a handle adapted to be housed inside a cavity of a piece of heating apparatus used to melt the wax before being applied. A roller is mounted in the opening of the device, the ends whereof are fitted by pushing them in both openings with insertion slots located in said two opposite sides of the cartridge opening.

Another type of applicator is disclosed in ES2076224, which describes an application device and a box, the application device containing a fixed receptacle of thermal conduction material wherein the product to be heated, especially depilation wax, is housed, and which is in the form of a rechargeable block, said receptacle having in its upper part an application head fitted with a roller. The box has means for heating the product, such as a block of depilation wax stored in said receptacle, to softening point.

Devices with interchangeable cartridges, such as those described above, for example, have the drawback of being costly for professional use since a large stock of wax cartridges have to be stored. These cartridges occupy storage and transport space, which increases the price per volume of wax stored. In order to solve this problem, there are application devices which incorporate a fixed, refillable container, which can be filled with wax which is stored in loose form. However, these applicators have the drawback that the roller, attached to the head of the devices, hinders access when the reservoir has to be refilled.

In order to provide a solution to the aforementioned drawbacks, ES2187693 discloses a depilation wax applicator which comprises a container which houses a fixed reservoir for wax inside, made of a good heat conduction material and which is thermally linked to heating means, and which incorporates an application roller positioned close to the opening of the reservoir. In particular, the aforementioned application roller is mounted on a runner which can move between a working position wherein the roller extends over the outlet hole of the reservoir, allowing the liquid wax to flow between its outer edge and the inner surface of the head, and a position of release from said hole in order to allow said reservoir to be filled with thermofusible product. Although some of the abovementioned drawbacks are overcome, this type of device still requires manual handling for the longitudinal movement in both directions of the runner, which may adopt any position between the working position and the release position, which is why correct use of the applicator cannot be guaranteed. On the other hand, no description is given in this document as to how the roller of the application device can be replaced.

With the arrival of beauty salons, which is what such establishments offering this depilation service to customers in a professional and more generalised way are called, this type of application has to overcome the problem arising from working with a large number of customers, which may involve the use of large quantities of wax, as well as the need to be able to quickly change the various additional components, such as the rollers, in the applicators.

There is a clear lack of any applicator for depilation wax which overcomes the aforementioned drawbacks, both as regards the need to be able to remove the roller from the opening of the device in order to refill the reservoir, to ensure that the latter is in the correct position for application, and the need for the user not to have to risk getting soiled when replacing the roller used.

EXPLANATION OF THE INVENTION

With the aim of providing a solution to the aforementioned problems, a device for applying depilation wax is disclosed, particularly for professional use, of the type that comprise a shell which is open at the top, in the form of a receptacle, which houses a heated reservoir inside, with an upper opening, suitable for storing hot wax; and a hollow tubular head attached to the opening of the shell, which comprises an inner runner, which can be moved longitudinally with respect to the head, which holds a rotatable roller used to apply a layer of hot wax stored in the reservoir onto the skin of a user.

In essence, the device is characterised in that the runner has means for holding the roller which comprise a swinging forked element, whereon the turning axle of the roller rests in an adjustable position and which can be rotated, and blocking means, it being possible to turn said forked element with respect to the runner, in order to move the roller in an essentially transverse direction with respect to the imaginary longitudinal axis of the applicator, from a blocking position, wherein the blocking means prevent the roller from separating from the head, to a release position, wherein the roller can be separated from the head.

In accordance with another characteristic of the invention, the runner, in its longitudinal movement, adopts two single extreme stable positions, the first being an operative position wherein the roller, with the turning axle resting on the forked element, is positioned between the walls of the head, the fork being prevented from moving by the blocking action of the roller against the body of the head, while the second is an open position wherein the roller is outside the head and the fork can turn freely with respect to the runner, it being possible meanwhile to move the roller from the blocking position to the release position.

In accordance with another characteristic of the invention, the blocking means of the holding means comprise extensions which are fixed with respect to the runner and configured in the form of a hook, which partially grip the roller axle and close the openings of the forked element when the latter is in the position wherein the roller, in its operative position, is situated on the imaginary longitudinal axis of the applicator.

In accordance with another characteristic of the invention, the applicator device comprises elastic means which force the runner to automatically move in the direction of the first or second extreme stable positions, when said runner is moved manually to a point close to the aforementioned first or second extreme stable positions, respectively.

In accordance with another characteristic of the invention, the head has a pushing element, which can be moved manually along a smooth orifice in the outer wall of the head, and the runner has dragging means suitable for receiving the holding and pushing action of the pushing element when the latter is moved in a direction towards the second stable position, and the runner is in the first stable position, it being possible to move the element that pushes the runner beyond said first stable position until the runner is automatically moved by the elastic means in the direction of the second stable position.

BRIEF DESCRIPTION OF THE DRAWINGS

The attached drawings illustrate a non-restrictive example of a preferred embodiment of the device for applying depilation wax, object of the invention. In said drawings.

DETAILED DESCRIPTION OF THE DRAWINGS

Figure 1:
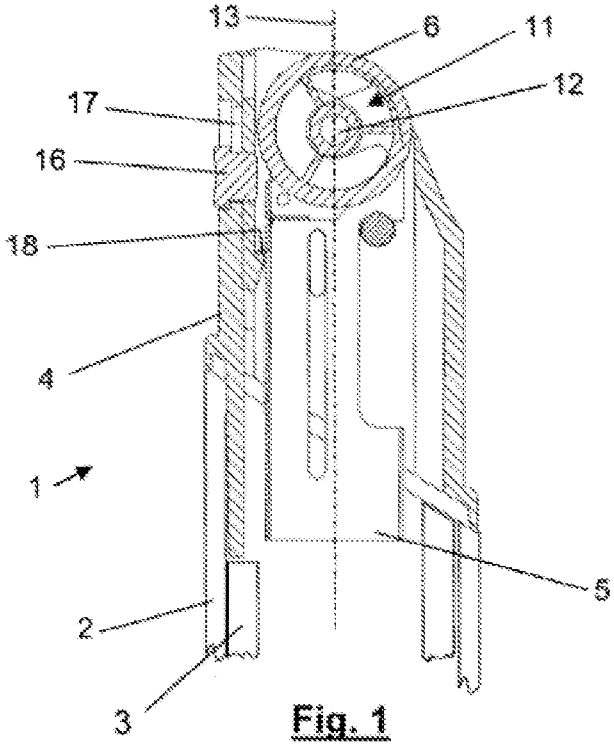
FIG. 1 is a partial view of a longitudinal section of the device object of the invention.

As shown in FIG. 1, the device 1 for applying depilation wax, object of the invention, comprises a shell 2 which is open at the top, in the form of a receptacle, which houses a heated reservoir 3 inside, with an upper opening, suitable for storing hot wax. This reservoir 3, unlike most devices known, is a fixed and refillable reservoir which stores the meltable wax.

The depilation wax applicator 1 has a hollow tubular head 4, attached to the upper opening of the shell 2, which comprises a runner 5 inside, which can move longitudinally with respect to the head 4 (as shown by arrow d in FIG. 2*c*) which holds a rotatable roller 6 used to apply a layer of hot wax stored in the reservoir 3 onto the skin of a user. The runner 5 has means 11 for holding the roller 6, the hold being adjustable but it also being possible to rotate the turning axle 12 of the roller 6.

Figures 2A, 2B, 2C, 2D, 2E:
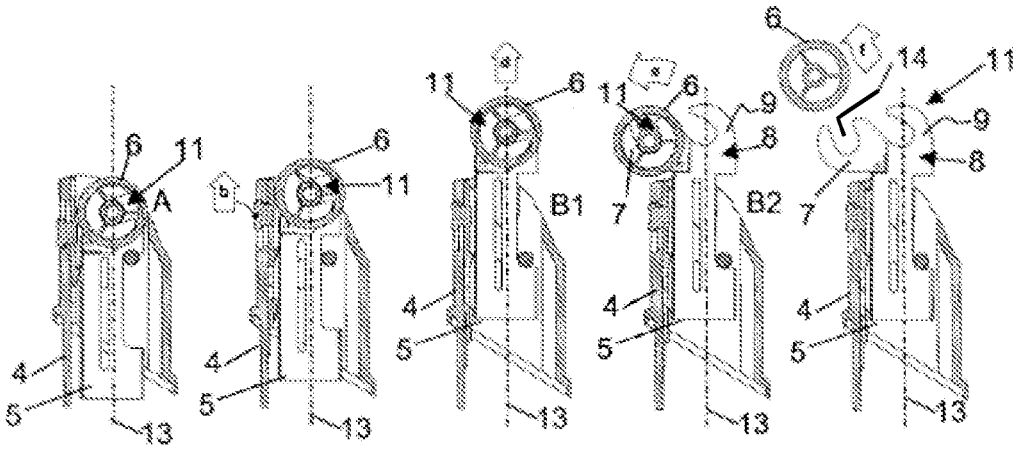
FIGS. 2*a*, 2*b*, 2*c*, 2*d* and 2*e* are a set of longitudinal section views of the head of the applicator device in FIG. 1 which represent a sequence of the longitudinal and transverse movement with respect to the head of the roller of said device.

As shown in detail in FIGS. 2*d* and 2*e*, the holding means 11 comprise a swinging forked element 7, whereon the turning axle 12 of the roller 6 rests in an adjustable position and which can be rotated, and blocking means 8, it being possible to turn said forked element 7 with respect to the runner 5 in order to move the roller 6, in an essentially transverse direction with respect to the imaginary longitudinal axis 13 of the applicator, from a blocking position B1, wherein the blocking means 8 prevent, as explained in detail further on, the roller 6 from separating from the head 4 (see FIGS. 2*a*, 2*b* and 2*c*), to a release position B2, wherein the roller 6 can be separated from the head 4 (see FIGS. 2*d* and 2*e*).

The blocking means 8 of the holding means 11 comprise extensions 9, which are fixed with respect to the runner 5, configured in the form of a hook, which partially grip the turning axle 12 of the roller 6 and close the openings 14 of the forked element 7 when the latter is in the blocking position B1, a position wherein the roller 6 is situated on the imaginary longitudinal axis 13 of the applicator 1. However, when the forked element 7 is turned with respect to the runner 5 in the direction indicated by arrow e of FIG. 2*d*, the fixed extensions 8 and the openings 14 of the forked element 7 do not coincide, allowing the roller 6 to be separated from the runner 5 as represented in FIG. 2*e*.

Said runner 5, in its longitudinal movement along the inside of the head 4, adopts two single extreme stable positions represented in FIGS. 2*a* and 2*c* to 2*e*, respectively, the first being an operative position A (see FIG. 2*a*) and the second being an open position B1;B2 (see FIGS. 2*c* to 2*e*). In FIG. 2*b*, a unstable position is represented between the two extreme stable positions.

When the reservoir 3 is to be filled or the roller 6 replaced, the applicator 1 functions as follows:

In the operative position A, wherein the roller 6 is held by the holding means 11, said roller 6 is positioned between the walls of the head 4, the forked element 7 being prevented from moving by the blocking action of the roller 6 against the body of the head 4.

Starting from the operative position A, the user moves the runner 5 upwards towards the open position B1:B2, so that the roller 6 is separated from the upper opening of the head 4, leaving said opening free and therefore the opening of the reservoir 3 of the applicator 1.

The runner 5 having reached the extreme stable position corresponding to the open position B1;B2, the forked element 7 can turn freely with respect to the runner 5, it also being possible to move the roller 6 from the blocking position B1, represented in FIG. 2*c*, to the release position B2, represented in FIG. 2*d*.

In order to fill the reservoir 3 of the applicator 1 with wax, the user can leave the roller 6 in the blocking position B1 or, for greater ease, can place the roller 6 in the release position B2 so that the roller 6 is not in the way when putting the wax into the reservoir 3. If the user needs to change the roller 6, said roller 6 has to be put in the release position B2, turning the forked element 7, to subsequently remove it in the direction f as shown in FIG. 2*e*.

Once the reservoir 3 has been filled and/or the roller 6 replaced, the forked element 7 must be turned from the release position B2 to the blocking position B1, and the runner 5 then moved from its open position B1;B2 until it reaches the extreme stable position corresponding to the operative position A.

In the applicator of the invention, movement of the runner 5 along the inside of the head 4 from the operative position A to the open position B1;B2 is semi-automatic. For this purpose, the applicator 1 has elastic means 15 which force the runner 5 to be held in the operative position A, and to slide it from said operative position A to the open position B1;B2 when the latter is moved slightly in the direction of the second extreme stable position, corresponding to the open position B1;B2.

Figure 3A:
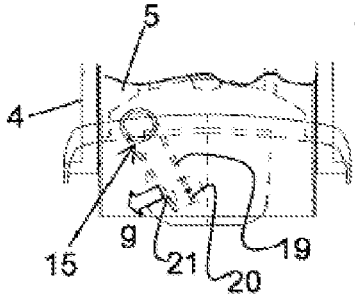
FIGS. 3*a*, 3*b* and 3*c* are a set of diagrammatic front views, which represent an operating sequence of the elastic means of the device in accordance with the invention.
Figure 3B:
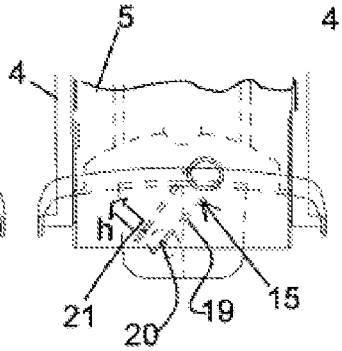
Figure 3C:
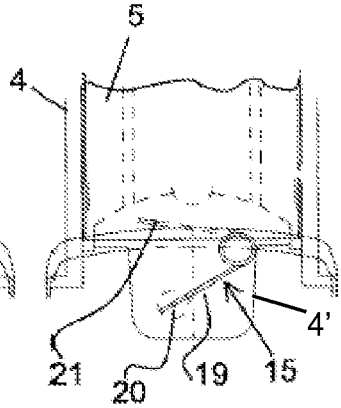

FIGS. 3*a* to 3*c* represent the sequence of the movement described above. In said figures it can be seen that the elastic means 15 are made up of a torsion spring 19 which joins the runner 5 to the head 4. One end 20 of this spring 19 is joined in a rotational way to the head 4, which is shown with a tongue/wing portion 4', and the other end 21, directly or indirectly, to the runner 5. In the position represented in FIG. 3*a*, wherein the runner 5 is in the operative position A, the spring 19 is compressed and pushes the runner 5 in the direction indicated by arrow g in said figure, forcing the runner 5 to remain in its first stable position.

When the runner moves 5 slightly in an upwards direction, the spring 19, still compressed, is forced to turn clockwise, whereby the end 20 joined to the runner 5 will separate from its other end 21 and pushes the runner 5 in the upward direction indicated by arrow h in FIG. 3*b*.

From this moment, the runner 5 will automatically be moved by the spring 19 to the second extreme stable position, represented in FIG. 3*c*. As can be seen in this figure, the ends 20 and 21 of the spring 19 have separated upon said spring 19 being decompressed.

Although not represented, it is assumed that the head 4 has two buffers to restrict the upper and lower path of the runner 5 along its inside, corresponding to the extreme stable positions of said runner 5.

In order to move the runner 5 from the position represented in FIG. 3*a*, corresponding to the operative position A, to the position represented in FIG. 3*b*, which corresponds to a position of unstable equilibrium of the runner 5, without having to pull from the runner 5 or the roller 6, the head 4 of the applicator device 1 of the invention has a pushing element 16. This pushing element 16 can be moved along a smooth orifice 17 in the outer wall of the head 4. The runner 5 has dragging means 18 suitable for receiving the resting and pushing action of the pushing element 16 when the runner 5 is in the operative position A, whereby the pushing element 16 can move the runner 5 beyond said operative position A, in other words, beyond the first stable position.

If one wishes to move the runner 5, the pushing element 16 is activated to move it, in the direction indicated by arrow b in said FIG. 2*b*, along the smooth orifice 17, from the position represented in FIGS. 1 and 2*a* to the position represented in FIG. 2*b*. When the pushing element 16 moves it drags the runner 5, making it move beyond the position of unstable equilibrium represented in FIG. 3*b*, causing it to move automatically via the decompression of the spring 19 to the second extreme stable position, corresponding to the open position B1;B2.

In order to return the runner 5 to the operative position A, all that needs to be done is push the runner 5 in the opposite direction beyond the position of unstable equilibrium represented in FIG. 3*b*, its movement from this position to the operative position A being automatic due to the action of the spring 19. This spring 19 ensures that the runner 5 always adopts one of its extreme stable positions, preventing the applicator from being used when the runner 5 is in an incorrect position, as can occur in other known applicators.

The invention claimed is:

1. A device for applying depilation wax, comprising a shell open at the top, in the form of a receptacle, which houses a reservoir inside, with an upper opening, suitable for storing hot wax; and a hollow tubular head attached to the opening of the shell, which comprises an inner runner, which can be moved longitudinally with respect to the head, and which holds a rotable roller, used to apply a layer of hot wax stored in the reservoir onto the skin of a user; wherein the runner has means for holding the roller which comprise a swinging forked element, whereon a turning axle of the roller rests in an adjustable position and which can be rotated, and blocking means, it being possible to turn said forked element with respect to the runner in order to move the roller, in an essentially transverse direction with respect to an imaginary longitudinal axis of the applicator, from a blocking position, wherein the roller is positioned on said imaginary longitudinal axis and wherein the blocking means prevent the roller from separating from the head, to a release position, wherein the roller can be separated from the head.

2. The device according to claim 1, wherein the runner, in its longitudinal movement, adopts two single extreme stable positions, the first being an operative position wherein the roller, with the turning axle resting on the forked element, is positioned between walls of the head, the forked element being prevented from moving by a blocking action of the roller against a body of the head, while the second is an open position wherein the roller is outside of the head and the forked element can turn freely with respect to the runner, it being possible to move the roller from the blocking position to the release position.

3. The device according to claim 2, wherein the device comprises elastic means which force the runner to automatically move in the direction towards the first or second extreme stable positions, when said runner is moved manually to a point close to said first or second extreme stable positions, respectively.

4. The device according to claim 3, wherein the head has a pushing element, which can be moved manually along a smooth orifice in an outer wall of the head, and in that the runner has dragging means for receiving a holding and pushing action of the pushing element when the pushing element is moved in a direction towards the second stable position, and when the runner is in the first stable position, it being possible to move the pushing element of the runner beyond said first stable position until the runner is automatically moved by the elastic means (15) in the direction of the second stable position.

5. The device according to claim 1, wherein the blocking means of the holding means comprise extensions, which are fixed with respect to the runner and configured in the form of a hook, which partially grip the roller axle and close openings of the forked element when the fork element is in the position wherein the roller, in an operative position, is situated on the imaginary longitudinal axis of the applicator.

6. The device according to claim 5, wherein the device comprises elastic means which force the runner to automatically move in the direction towards the first or second extreme stable positions, when said runner is moved manually to a point close to said first or second extreme stable positions, respectively.

7. The device according to claim 1, wherein the reservoir is configured for heating depilation wax.

8. A device for applying depilation wax, comprising:

a shell in the form of a receptacle comprising an opening at a first end;

a reservoir housed inside the shell, the reservoir comprising an opening configured to store hot wax;

a hollow tubular head comprising an inner runner moveable longitudinally with respect to the head, the runner comprising a swinging forked element;

a rotable roller held by the head, the rotable roller configure to apply a layer of the hot wax stored in the reservoir onto the skin of a user; the roller comprising a axle, the swinging forked element of the runner configured to hold the roller, whereon the axle of the roller rests and is rotatable;

a hook configured to hook onto and secure the roller to prevent the roller from separating from the head; and the fork element configured to turn relative to the runner in order to move the roller away from a longitudinal axis of the applicator to a release position, wherein the roller can be separated from the head.

9. The device according to claim 8, wherein the runner, through longitudinal movement of the runner, adopts two extreme stable positions, a first position and a second position;

the first position is an operative position wherein the roller supported by the forked element is positioned within the head in a blocking position, the fork thereby prevented from moving by a blocking action of the roller against a body portion of the head;

the second position is an open position wherein the roller is outside of the head and the fork is free to move relative to the runner, thereby allowing the roller to move from the blocking position to the release position.

10. The device according to claim 9, wherein the device comprises a spring that forces the runner to automatically move in the direction towards the first position or the second position when the runner is moved manually to a point close to the first position or the second position, respectively.

11. The device according to claim 10, wherein the head comprises a pushing tab manually moveable along an orifice in an outer wall of the head, the pushing tab coupled to the runner to transmit to the runner a pushing action of the pushing element when the pushing element is moved in a direction towards the second position and back to the first position, such that when the runner is in the first position, the pushing element initially moves the runner from the first position until the runner is automatically moved by the spring in the direction of the second position.

12. The device according to claim 9, wherein the reservoir is configured for heating depilation wax.

13. The device according to claim 8, wherein the hook comprises extensions fixed with respect to the runner and that at least partially grip the roller axle and close an opening of the forked element when the fork element is in the position wherein the roller, in an operative position, is on the longitudinal axis of the applicator.

14. The device according to claim 13, wherein the device comprises a spring that forces the runner to automatically move in the direction towards the first position or the second positions when the runner is moved manually to a point close to the first position or the second position, respectively.

* * * * *